United States Patent [19]

Hashimoto et al.

[11] Patent Number: 4,834,054

[45] Date of Patent: May 30, 1989

[54] METHOD OF DETECTING A FAULT OF AN EXHAUST GAS RECIRCULATION SYSTEM

[75] Inventors: Toru Hashimoto; Akira Takahashi, both of Kyoto; Takeshi Imaizumi, Anjo; Susumu Saito, Toyota; Hiroshi Tanaka, Kyoto; Takeshi Jimbo, Okazaki, all of Japan

[73] Assignee: Mitsubishi Jidosha Kogyo Kabushiki Kaisha, Tokyo, Japan

[21] Appl. No.: 177,963

[22] Filed: Apr. 5, 1988

[30] Foreign Application Priority Data

Apr. 10, 1987 [JP] Japan ..... 62-88536

[51] Int. Cl.[4] ..... F02M 25/06

[52] U.S. Cl. ..... 123/571; 364/431.06

[58] Field of Search ..... 123/568, 569, 570, 571, 123/479; 364/431.06

[56] References Cited

U.S. PATENT DOCUMENTS

| | | | |
|---|---|---|---|
| 4,375,800 | 3/1983 | Otsuka et al. | 123/571 |
| 4,428,355 | 1/1984 | Yokooku | 123/571 |
| 4,432,331 | 2/1984 | Yasuhara | 123/571 |
| 4,471,745 | 9/1984 | Yoshioka et al. | 123/571 |
| 4,541,398 | 9/1985 | Kishi | 123/571 |
| 4,665,882 | 5/1987 | Otobe | 123/571 |
| 4,690,120 | 9/1987 | Egle | 123/571 |
| 4,715,348 | 12/1987 | Kobayashi et al. | 123/571 |
| 4,723,527 | 2/1988 | Panten et al. | 123/571 |
| 4,770,148 | 9/1988 | Hibino et al. | 123/571 X |

FOREIGN PATENT DOCUMENTS

| | | | |
|---|---|---|---|
| 0093950 | 7/1980 | Japan | 123/571 |
| 0185857 | 10/1984 | Japan | 123/571 |

*Primary Examiner*—Willis R. Wolfe

*Attorney, Agent, or Firm*—Frishauf, Holtz, Goodman & Woodward

[57] ABSTRACT

A method of detecting a fault of an exhaust gas recirculation system of an internal combustion engine, comprising detecting a temperature relating to a temperature of a gas recirculating through the exhaust gas recirculation system when the system is in a condition in which the system should be operated to return part of an exhaust gas of the engine to an intake passage, and detecting that the exhaust gas recirculation system is defective when the detected temperature is lower than a fault discriminating value. A condition of air to be sucked into the engine, such as intake air temperature and atmospheric pressure, is detected, and the fault discriminating value is set in accordance with the detected air condition, whereby abnormality or fault of the exhaust gas recirculation system can be detected accurately and reliably. Preferably, the fault detection is inhibited until the engine temperature reaches a predetermined value and/or a predetermined time period elapses after the start-up of the engine, whereby erroneous fault detection can be prevented.

7 Claims, 4 Drawing Sheets

METHOD OF DETECTING A FAULT OF AN EXHAUST GAS RECIRCULATION SYSTEM

BACKGROUND OF THE INVENTION

This invention relates to a method of detecting a fault of an exhaust gas recirculation system which recirculates or returns part of the exhaust gas of an internal combustion engine to an intake passage of the same.

Conventionally, an exhaust gas recirculation system is known which recirculates part of the exhaust gas discharged from an internal combustion engine to the intake passage so as to decrease the amounts of noxious ingredients in the exhaust gas, such as NOx. The exhaust gas recirculation system includes an exhaust gas recirculation passage connecting the exhaust passage to the intake passage, an exhaust gas recirculation valve (hereinafter referred to as "EGR valve") arranged in the exhaust gas recirculation passage for opening/closing the same, and a control unit for controlling the operation of the EGR valve. The EGR valve is opened/closed in accordance with the operating conditions of the engine, such that a suitable amount of the exhaust gas flows back to the intake passage.

If, however, carbon etc. contained in the exhaust gas accumulates in the EGR valve of the exhaust gas recirculation system and decreases the opening of the passage, the necessary amount of exhaust gas cannot be introduced into the intake passage, thus degrading the emission characteristics of the engine. Such abnormality or fault of the exhaust gas recirculation system cannot usually be noticed by the driver unless it is detected by some fault detecting means.

Conventionally, A method is known in which the temperture of the recirculated exhaust gas is detected by a temperature sensor (hereinafter referred to as "EGR temperature sensor") arranged near the EGR valve either in communication with the exhaust gas recirculation passage or with a wall intervening therebetween when the exhaust gas recirculation system is in a condition in which it should be operated, thereby to detect a fault of the system. The fault detection of this method is based on the understanding that the temperature detected by the EGR temperature sensor differs greatly between the case where the EGR valve etc. operate normally and therefore a required amount of exhaust gas flows therethrough and the case where no or very little exhaust gas flows through the system due to abnormality of the EGR valve etc. Thus, the temperature difference is utilized for the detection of fault of the exhaust gas recirculation system. In this method, the exhaust gas recirculation system is determined to be defective when the temperature of the recirculated exhaust gas, detected by the EGR temperature sensor, is lower than a predetermined fault discrimination value.

However, the temperature of the recirculated exhaust gas varies largely in response to various conditions of air to be sucked into the engine, e.g., intake air temperature and atmospheric pressure. In the fault detecting method described above, therefore, if a single and fixed value is used as the fault discrimination value, it must be set at a low value in consideration of various engine operating conditions. And, if the fault detection is made using such a low fault-discriminating temperature, the exhaust gas recirculation system can erroneously be detected to be operating normally thought it actually is defective.

Further, when the engine is not yet completely warmed up immediately after the start-up, its operation is unstable and therefore, the temperature of the recirculated exhaust gas is varying unstably. While the engine is operating in such a condition, an accurate fault detection of the exhaust gas recirculation system cannot be made with the above method, possibly causing an erroneous detection.

OBJECTS AND SUMMARY OF THE INVENTION

The primary object of the invention is to provide a method of detecting a fault of an exhaust gas recirculation system which is capable of detecting abnormality or fault of the system accurately and reliably, whereby the defective system can be quickly taken care of or repaired.

The invention provides a fault detecting method wherein a temperature relating to the temperature of exhaust gas recirculating through an exhaust gas recirculation system is detected when the exhaust gas recirculation system is required to operate to return part of the exhaust gas to the intake passage. When the detected temperature is lower than a fault discriminating temperature, it is determined that the exhaust gas recirculation system is defective.

In the method of the invention, the fault discriminating temperature is set in accordance with the detected conditions of air to be sucked into the engine, such as intake air temperature, and atmospheric pressure.

Preferably, a temperature representative of the engine temperature is detected. The fault detection is inhibited until the detected temperature representing the engine temperature reaches a predetermined value after the start-up of the engine.

Still preferably, lapse of time is measured after the start-up of the engine, and the fault detection is inhibited until a predetermined period of time elapses after the start-up of the engine.

The above and other objects, features, and advantages of the invention will become more apparent from the following detailed description taken in conjunction with the accompanying drawings.

DETAILED DESCRIPTION

Figure 1:
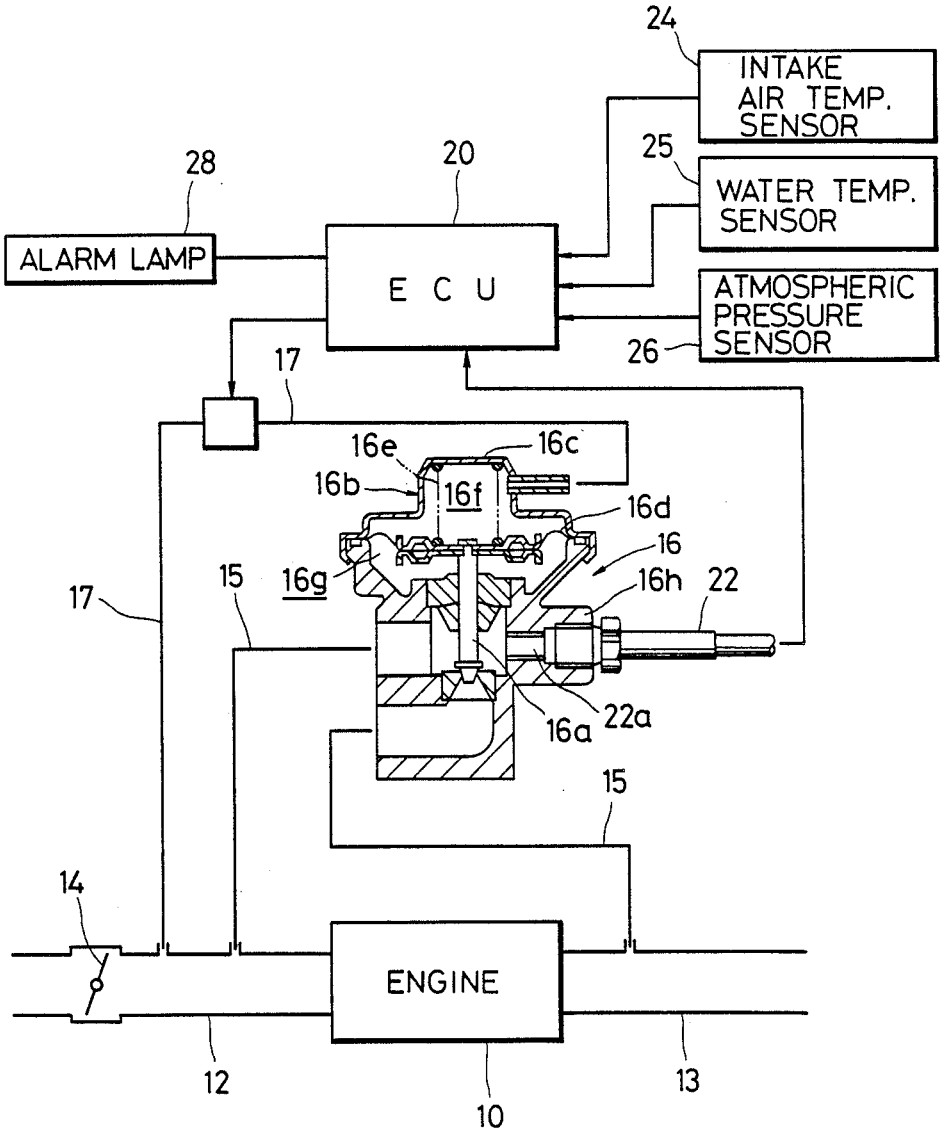
FIG. 1 is a block diagram schematically showing an exhaust gas recirculation system to which the method of the invention is applied.

First, the entire construction of an exhaust gas recirculation system to which the method of the invention is applied is described with reference to FIG. 1.

An internal combustion engine 10 is connected with an intake passage 12 and an exhaust passage 13 at the suction and exhaust sides, respectively. A throttle valve 14 is arranged in the intake passage 12. An exhaust gas recirculation passage 15 has one end connected to the intake passage 12 at a location downstream of the throttle valve 14, and the other end connected to the exhaust passage 13.

An exhaust gas recirculation (EGR) valve 16 is arranged in the exhaust gas recirculation passage 15. The EGR valve 16 includes a valve member **16*a* for opening/closing the exhaust gas recirculation passage 15, and an actuator 16*b* for actuating the valve member 16*a*. The actuator 16*b* includes a housing 16*c*, a diaphragm 16*d* arranged within the housing 16*c* for dividing the interior of the housing 16*c* into negative pressure chamber 16*f* and atmospheric pressure chamber 16*g* and coupled to the valve member 16*a*, and a spring 16*e* arranged within the negative pressure chamber 16*f* and urging the diaphragm 16*d* in such a direction as to close the valve member 16*a***.

A negative pressure passage 17 has one end connected to the negative pressure chamber **16*f* of the actuator 16*b*, and the other end connected at the other end to a portion of the intake passage 12 downstream of the throttle valve 14. Thus, a negative pressure produced in the intake passage 12 at a location downstream of the throttle valve 14 is introduced into the negative pressure chamber 16*f* through the negative pressure passage 17. A normally closed solenoid valve 18 is arranged in the negative pressure passage 17 and electrically connected to an electronic control unit (ECU) 20. The solenoid valve 18 opens in response to a drive signal supplied from the electronic control unit 20, thereby introducing the negative pressure into the negative pressure chamber 16*f* of the actuator 16*b***.

An EGR temperature sensor 22 is attached to a side wall **16*h* of the EGR valve 16 and has a thermosensitive section 22*a* at its tip. The section 22*a* is exposed to the exhaust gas recirculation passage 15 and thus in communication therewith at a location downstream of the valve member 16*f*. The EGR temperature sensor 22 detects the temperature of the recirculated exhaust gas and applies the detected temperature signal to the electronic control unit 20**.

To the input of the electronic control unit 20 are connected various sensors for detecting the operating conditions of the engine 10, e.g., intake air temperature sensor 24 arranged near the atmosphere-opening end of the intake passage 12, for detecting the temperature of intake air, water temperature sensor 25 for detecting the cooling water of the engine 10 as representative of the engine temperature, atmospheric pressure sensor 26 for detecting the atmospheric pressure, engine speed sensor (not shown), and a sensor for detecting the amount of intake air (not shown). Various detection signals from these sensors are supplied to the electronic control unit 20. To the output of the electronic control unit 20 is connected an alarm lamp 28 for giving a warning when a fault of the exhaust gas recirculation system is detected. The alarm lamp 28 is provided, for example, on the instrument panel of a vehicle.

Next, the operation of the exhaust gas recirculation system, constructed as above, will be described. The valve member **16*a* of the EGR valve 16 is urged all the time by the spring 16*a* in the closing direction, and therefore, the EGR valve 16 is normally closed. The electronic control unit 20 is supplied with the detection signals from the above-mentioned various sensors, and outputs a drive signal to the solenoid valve 18 to open the same when the engine 10 is operating in a predetermined condition. As the solenoid valve 18 opens, the negative pressure produced in the intake passage 12 at a location downstream of the throttle valve 14 is supplied to the negative pressure chamber 16*f* of the actuator 16*b* through the negative pressure passage 17. The atmospheric pressure applied to the surface of the diaphragm 16*d* facing the atmospheric pressure chamber 16*g* is higher than the negative pressure applied to the surface of the diaphragm 16*d* facing the negative pressure chamber 16*f*. As a result, the atmospheric pressure acts to displace the valve member 16*a* upward in the figure against the urging force of the spring 16*e*, thereby opening the EGR valve 16. Upon opening of the EGR valve 16, part of the exhaust gas in the exhaust passage 13 flows to the intake passage 12 through the exhaust gas recirculation passage 15**.

A method of detecting a fault of the exhaust recirculation system, which is carried out by the electronic control unit 20, will now be described with reference to FIGS. 2 to 5.

Figure 2:
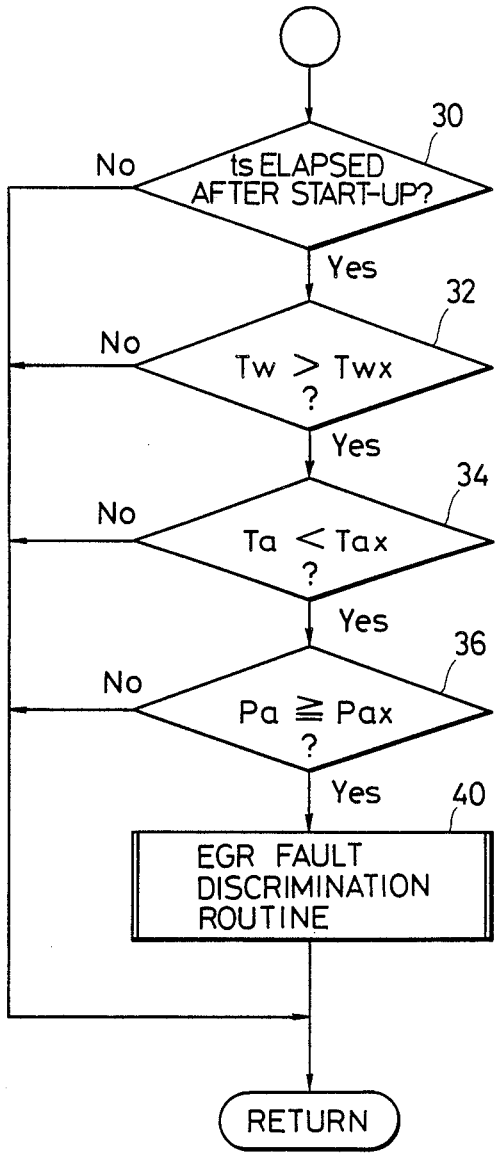
FIG. 2 is a flowchart showing a program which is executed by an electronic control unit (ECU) 20 in FIG. 1 to determine whether or not fault detection of the exhaust gas recirculation system should be performed.

FIG. 2 shows a program which is executed when the exhaust gas recirculation system is required to operate, that is, the EGR valve 16 is required to open to return part of the exhaust gas to the intake passage 12 through the exhaust gas recirculation passage 15. In this program routine, it is determined whether or not the fault detection of the exhaust gas recirculation system should be carried out.

In step 30, the electronic control unit 20 determines whether or not the time period ts (unit: minutes) has elapsed after the start-up of the engine 10. Immediately after the start-up of the engine 10, the engine is not sufficiently warmed up and accordingly the temperature of the exhaust gas is varying unstably. If the fault detection of the exhaust gas recirculation system is carried out while the temperature of the exhaust gas is varying unstably, an erroneous detection can be made. For this reason, if the determination in step 30 is negative (NO), that is, when the engine 10 is not yet sufficiently warmed up, the program routine is ended, without making the fault detection described hereinafter.

Figure 3:
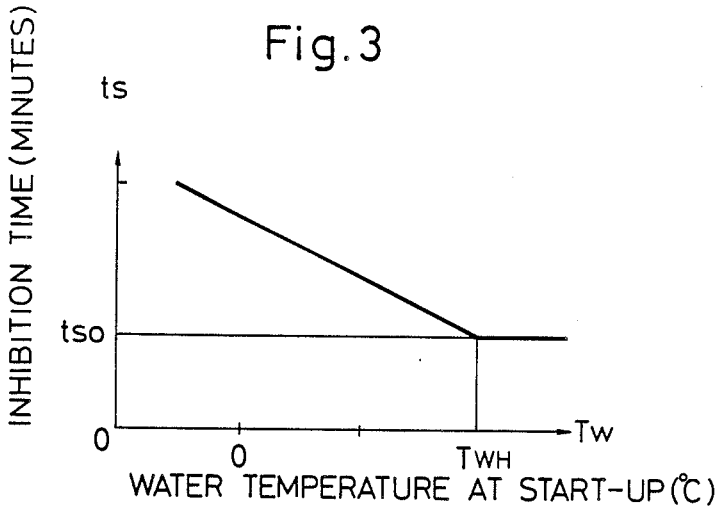
FIG. 3 is a graph showing the relationship between fault detection inhibition time ts and temperature Tw of cooling water immediately after the start-up of the engine.

The time necessary for completing the warm-up of the engine 10 depends upon the temperature of the cooling water at the start-up of the engine 10. Therefore, the time ts during which the fault detection is inhibited is preferably set in accordance with the cooling water temperature detected immediately after the start-up of the engine 10 by the water temperature sensor 25. FIG. 3 is a graph showing the relationship between the fault detection inhibition time ts and the water temperature Tw at the start-up of the engine. As shown in the graph, the inhibition time ts is set to a shorter time with an increase in the water temperature Tw detected immediately after the start-up of the engine 10. Even in the case where the water temperature Tw at the start-up of the engine 10 is higher than the temperature $T_{WH}$ at which the engine 10 can be regarded as being warmed up enough, the inhibition time ts is used and preferably set to minimum time tso (e.g., 2 minutes), so that the fault detection may be made after the operation of the engine 10 has become completely stable.

If the determination in step 30 is affirmative (YES), then it is determined whether the engine water temperature Tw is higher than a predetermined value $T_{WX}$ (e.g., 80° C.), in step 32. This step is provided to further determine whether the engine 10 has been sufficiently warmed up, in addition to step 30. If NO in step 32, the program routine is ended without making the fault detection.

If YES in step 32, the electronic control unit 20 determines whether or not the intake air temperature Ta detected by the intake air temperature sensor 24 is lower than a predetermined value Tax (e.g., 60° C.), in step 34. When the intake air temperature Ta is higher than the predetermined value (i.e., if NO in step 34), it is probable that the temperatures of the EGR valve 16 and the EGR temperature sensor 22 themselves are high even though the exhaust gas is not recirculated through the exhaust gas recirculation system. In this case, since the temperature of the recirculated exhaust gas cannot be measured accurately, the fault detection is not carried out and the program routine is ended. The determination in step 34 may not be based on the temperature detected by the intake air temperature sensor 12 arranged near the end of the intake passage 12 opening to the atmosphere, as described above. Alternatively, another sensor for detecting the temperature of air surrounding the engine 10 (i.e., ambient temperature) may be used to make the determination as to whether the fault detection should be carried out.

If YES in step 34, the program proceeds to step 36 to determine whether the atmospheric pressure Pa detected by the atmospheric pressure sensor 26 is equal to or higher than a predetermined value Pax (e.g., 700 mmHg). In the case where the engine 10 is operated in a low atmospheric pressure condition such as in a place at high altitude, the temperature of the exhaust gas and accordingly that of the recirculated exhaust gas are low. Thus, if the atmospheric pressure Pa is lower than the predetermined value Pax (that is, if NO is step 36), the program routine is ended without making the fault detection, because a decrease in the temperature of the recirculated exhaust gas is in this case not negligible.

If YES in each of the above steps, it is determined that the fault detection of the exhaust gas recirculation system can be carried out. In this case, program proceeds to step 40 in which the electronic control unit 20 executes the fault discrimination routine for the exhaust gas recirculation system (EGR system), shown in FIG. 4.

Figure 5:
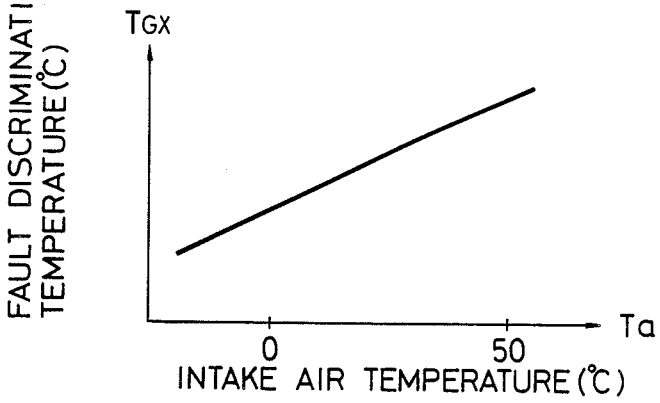
FIG. 5 is a graph showing the relationship between fault discriminating temperature $T_{GX}$ and intake air temperature Ta.

First, in step 41 of the fault discrimination routine, the electronic control unit 20 sets fault discriminating temperature $T_{GX}$ which is used for the fault detection. That is, a suitable fault discriminating temperature $T_{GX}$ value is read out from a table stored in a memory (not shown) of the electronic control unit 20, on the basis of the intake air temperature Ta detected by the intake air temperature sensor 24. FIG. 5 shows the $T_{GX}$-Ta table stored in the memory. As shown in the table, the fault discriminating temperature $T_{GX}$ is set to a higher value as the intake air temperature Ta increases. The fault discriminating temperature $T_{GX}$ is set as a function of the intake air temperature Ta. Since the temperature $T_G$ of the recirculated exhaust gas is variable in dependence upon various factors, e.g., the configuration of the EGR valve 16, the size of the exhaust gas recirculation passage 15, the amount of the recirculated gas, the mounting position of the EGR temperature sensor 22, etc., the $T_{GX}$-Ta table shown in FIG. 5 should preferably be determined experimentally for each of engines.

Then, the electronic control unit 20 compares the temperature $T_G$ of the recirculated exhaust gas, detected by the EGR temperature sensor 22, with the fault discriminating temperature $T_{GX}$ set in step 41, to determine whether the former is higher than the latter (step 42). When the EGR valve 16 is open and the exhaust gas is normally recirculated through the exhaust gas recirculation passage 15, that is, when the exhaust gas recirculation system is operating normally, the recirculated exhaust gas temperature $T_G$ detected by the EGR temperature sensor 22 is sufficiently higher than the fault discriminating temperature $T_{GX}$. In this case, the determination in step 42 is affirmative, and therefore, the electronic control unit 20 resets a timer hereinafter referred to (step 44) and then ends the fault discrimination routine.

If the recirculated exhaust gas temperature $T_G$ is lower than the fault discriminating temperature $T_{GX}$, that is, if NO in step 42, the electronic control unit 20 executes step 42 to determine whether a predetermined period of time $t_G$ (e.g., 30 seconds) has elapsed since the determination in step 42 provides NO for the first time, that is, whether the timer which was reset in normal operation of the exhaust gas recirculation system in step 44 has counted a count corresponding to the predetermined time $t_G$. This timer may either be a so-called hard timer incorporated into the electronic control unit 20 or a so-called soft timer which measures a time period on the basis of the execution of program. If the predetermined time period $t_G$ has not yet elapsed, the exhaust gas recirculation system is determined not to be defective even if the recirculated exhaust gas temperature $T_G$ is lower than the fault discriminating temperature $T_{GX}$, terminating the execution of the fault discrimination routine. This determination serves to prevent erroneous detections from being caused by noise.

If the temperature $T_G$ of the recirculated exhaust remains below the fault discriminating temperature $T_{GX}$ and therefore step 46 is repeatedly executed over the predetermined time period $t_G$, the electronic control unit 20 determines that the exhaust gas recirculation system is defective. That is, step 48 is executed to light the alarm lamp 28, thereby informing the driver of the fault of the exhaust gas recirculation system. Thus, the driver notices the fault of the exhaust gas recirculation system promptly and can take the necessary steps.

Although in the above embodiment, the EGR temperature sensor 22 is attached to the side wall **16*h* near the valve member 16*a* of the EGR valve 16, the mounting position of the sensor 22 is not limited to this alone. The sensor 22 can be arranged in any position in the exhaust gas recirculation passage 15, either downstream or upstream of the EGR valve 16**.

Further, the EGR temperature sensor 22 of the embodiment is adapted to measure directly the temperature of the recirculated exhaust gas. The present invention can be achieved without any inconveniences so far as the EGR temperature sensor 22 detects a temperature relating to the recirculated exhaust gas temperature. For example, the sensor 22 can be attached to the side wall **16*h* adjacent to the valve member 16*a* of the EGR valve 16, for detecting the recirculated exhaust gas temperature indirectly through the side wall 16***h*.

Although the foregoing embodiment uses the engine cooling water temperature as representative of the engine temperature, the engine temperature can be detected differently, e.g., from the engine oil temperature.

Still further, in the embodiment, the fault discriminating temperature $T_{GX}$ is set as a function of the intake air temperature Ta. It may alternatively be set in accordance with the ambient temperature of the engine 10 (i.e., temperature of the air surrounding the engine 10). Also, the temperature $T_{GX}$ can be set in accordance with the atmospheric pressure, or in accordance with both the intake air temperature Ta and the atmospheric pressure.

In the case of internal combustion engines installed in vehicles which are seldom used under such lower atmospheric pressure conditions than standard atmospheric pressure, the fault discriminating temperature $T_{GX}$ can be set at a value without regard to the atmospheric pressure (for example, it can be set to a fixed value). In such cases, the fault detection of the exhaust gas recirculation system may be inhibited only when the engine is operated under an atmospheric pressure condition lower than the predetermined value, such as in a place at a high altitude. In contrast, in the case where the engine is to be operated in a place in which the atmospheric pressure changes largely, the fault discriminating temperature $T_{GX}$ should preferably be set in relation to the atmospheric pressure.

When the fault discriminating temperature $T_{GX}$ is set in accordance with the atmospheric pressure, the electronic control unit 20 calculates, in step 41 of the fault discrimination routine, a suitable fault discriminating temperature $T_{GX}$ on the basis of the atmospheric pressure Pa detected by the atmospheric pressure sensor 26, using the following equation (1):

$$T_{GX}=(Pa/Po)\times T_{G0} \quad (1)$$

where Po is the standard atmospheric pressure (760 mmHg), and $T_{G0}$ is the basic fault discriminating temperature set according to the standard atmospheric pressure.

Figure 6:
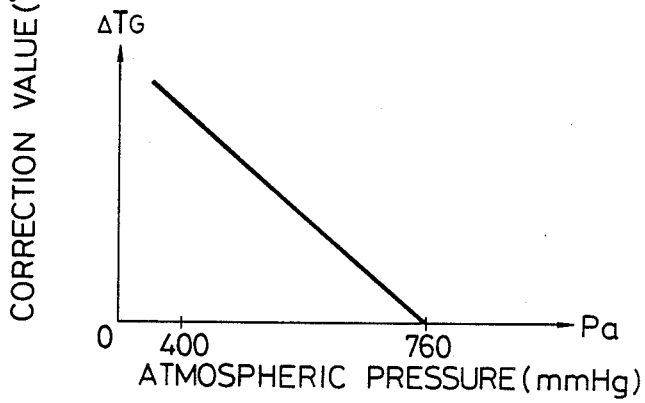
FIG. 6 is a graph showing the relationship between fault discriminating temperature $T_{GX}$ and atmospheric pressure Pa, used when fault discriminating temperature $T_{GX}$ is set in accordance with atmospheric pressure Pa.
Figure 4:
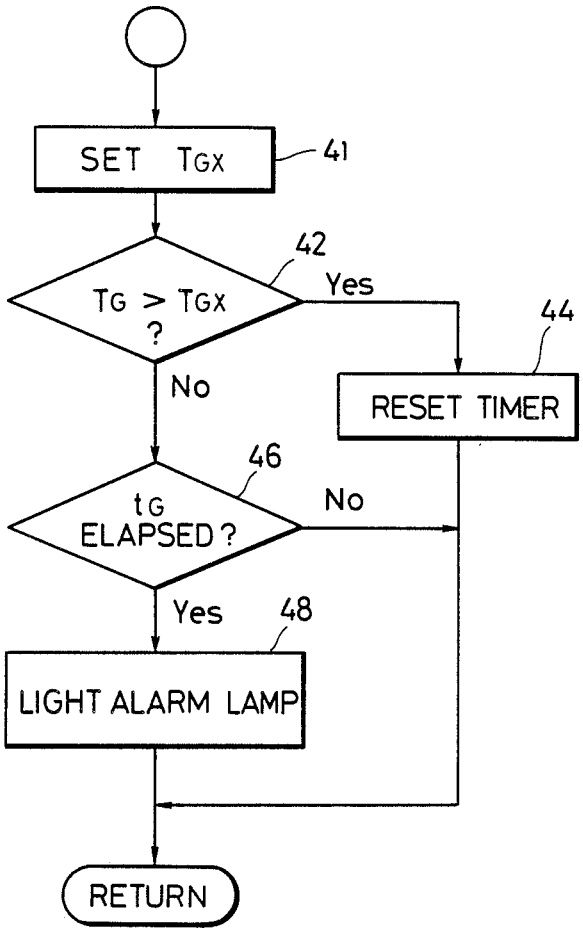
FIG. 4 is a flowchart showing an EGR fault discrimination routine shown in step 40 of FIG. 2.

The fault discriminating temperature $T_{GX}$ may alternatively be obtained by the following equation (2), in lieu of equation (1):

$$T_{GX}=T_{G0}-\Delta T_G \quad (2)$$

where $T_{G0}$ is, as stated above with reference to equation (1), the basic fault discriminating temperature set in accordance with the standard atmospheric pressure, and $\Delta T_G$ is the correction value read out from the table stored in the memory (not shown) of the electronic control unit 20, in accordance with the atmospheric pressure Pa detected by the atmospheric pressure sensor 26. FIG. 6 is a table showing the relationship between the correction value $\Delta T_G$ and the atmospheric pressure Pa stored in the memory. As shown in the graph, the fault discrimination-temperature correction value $\Delta T_G$ is set to a greater value as the atmospheric pressure Pa decreases. The correction value $\Delta T_G$ is set as a function of the atmospheric pressure Pa. However, since various factors such as the configuration of the EGR valve 16, the size of the exhaust gas recirculation passage 15, and the amount of recirculated exhaust gas must be considered, the correction value $\Delta T_G$ should preferably be set experimentally for each of engines.

What is claimed is:

1. A method of detecting a fault of an exhaust gas recirculation system of an internal combustion engine, wherein a temperature relating to a temperature of the exhaust gas recirculating through said exhaust gas recirculation system is detected when said exhaust gas recirculation system is in a condition in which said system should be operated to return part of the exhaust gas of said engine to an intake passage, and it is detected that said exhaust gas recirculation system is defective, when the detected temperature is lower than a fault discriminating value, said method comprising:

detecting a condition of air to be sucked into the engine; and setting said fault discriminating value in accordance with the detected condition of air.

2. The method according to claim 1, wherein a temperature of intake air is detected, and said fault discriminating value is set in accordance with the detected intake air temperature.

3. The method according to claim 1, wherein an atmospheric pressure is detected, and said fault discriminating value is set in accordance with the detected atmospheric pressure.

4. The method according to claim 1, further comprising detecting a temperature representative of an engine temperature of said engine, and wherein said fault detection is inhibited until the detected temperature representing the engine temperature reaches a predetermined value.

5. The method according to claim 1, wherein said temperature representative of the engine temperature is a temperature of engine cooling water.

6. The method according to claim 1, further comprising measuring a time period from a start-up of said engine, wherein said fault detection is inhibited until a predetermined period of time elapses after the start-up of said engine.

7. The method according to claim 6, wherein said predetermined period of time is set in accordance with a temperature of said engine detected immediately after the start-up of said engine.

* * * * *